US009541072B2

(12) United States Patent
Howind et al.

(10) Patent No.: US 9,541,072 B2
(45) Date of Patent: Jan. 10, 2017

(54) ADJUSTMENT APPARATUS FOR A HYDROSTATIC PISTON MACHINE, AND HYDROSTATIC PISTON MACHINE HAVING AN ADJUSTMENT APPARATUS OF THIS KIND

(71) Applicant: Robert Bosch GmbH, Stuttgart (DE)

(72) Inventors: Joern Howind, Tuebingen (DE); Rolf Springmann, Sulz-Hopfau (DE)

(73) Assignee: Robert Bosch GmbH, Stuttgart (DE)

( * ) Notice: Subject to any disclaimer, the term of this patent is extended or adjusted under 35 U.S.C. 154(b) by 280 days.

(21) Appl. No.: 14/068,358

(22) Filed: Oct. 31, 2013

(65) Prior Publication Data

US 2014/0116242 A1 May 1, 2014

(30) Foreign Application Priority Data

Oct. 31, 2012 (DE) ..... 10 2012 021 320

(51) Int. Cl.
*F15B 15/08* (2006.01)
*F04B 1/32* (2006.01)

(52) U.S. Cl.
CPC ..... *F04B 1/32* (2013.01)

(58) Field of Classification Search
CPC ... F04B 1/32; F04B 1/324; F15B 2211/20553; F15B 2211/20546
See application file for complete search history.

(56) References Cited

U.S. PATENT DOCUMENTS 4,553,605 A * 11/1985 Katayama ..... A01B 63/114 172/2
6,044,857 A * 4/2000 Stege ..... G05B 19/042 137/1
6,419,031 B1 * 7/2002 Poysti ..... E21B 44/00 175/24
6,725,658 B1 * 4/2004 Lemmen et al. ..... 60/444
7,089,733 B1 * 8/2006 Jackson et al. ..... 60/422
2008/0042087 A1 * 2/2008 Pfaff ..... 251/129.04
2010/0199838 A1 * 8/2010 Krebs et al. ..... 91/505
2014/0130661 A1 * 5/2014 Howind ..... F04B 49/123 91/506

FOREIGN PATENT DOCUMENTS

DE 100 63 525 A1 7/2002
DE 103 60 452 B3 9/2005
DE 10 2008 048 507 A1 3/2010
DE 10 2010 054 100 A1 1/2012

* cited by examiner

*Primary Examiner* — John K Fristoe, Jr.
*Assistant Examiner* — Richard Drake
(74) *Attorney, Agent, or Firm* — Maginot, Moore & Beck LLP

(57) ABSTRACT

An adjustment apparatus for a pivot cradle of an axial piston machine includes an actuating piston configured to enable the pivot cradle to be pivoted about a pivot axis. The actuating piston delimits an actuating chamber by which pressure medium is configured to be applied to the actuating piston. The charging of pressure medium to and the discharging of pressure medium from the actuating chamber is controlled by a regulating valve. The regulating valve has a regulating piston configured to be adjusted by a solenoid. The regulating piston and the actuating piston are mechanically coupled to one another. Current is supplied to the solenoid depending on a setpoint pivot angle of the pivot cradle and depending on the previous state of the setpoint pivot angle, thereby largely reducing hysteresis effects of the solenoid.

11 Claims, 3 Drawing Sheets

ADJUSTMENT APPARATUS FOR A HYDROSTATIC PISTON MACHINE, AND HYDROSTATIC PISTON MACHINE HAVING AN ADJUSTMENT APPARATUS OF THIS KIND

This application claims priority under 35 U.S.C. §119 to patent application no. DE 10 2012 021 320.4 filed on Oct. 31, 2012 in Germany, the disclosure of which is incorporated herein by reference in its entirety.

BACKGROUND

The disclosure relates to an adjustment apparatus for a hydrostatic piston machine, in particular a hydrostatic axial piston machine of swash-plate design or of inclined-axis design, and to a hydrostatic piston machine having an adjustment apparatus of this kind.

DE 10 2008 048 507 A1 discloses an adjustment apparatus of this kind for hydrostatic piston machines. Said adjustment apparatus has an actuating piston which can be moved between two end positions and which is adjoined by two opposite actuating chambers to which pressure medium can be supplied and from which pressure medium can be discharged. The supply and discharge of pressure medium is controlled by a regulating piston of a regulating valve. A regulating force, which is dependent on the position of the actuating piston, is applied to said regulating valve, said regulating force being directed against a control force which acts on the regulating piston and acting in the direction of an inoperative position of the actuating apparatus. In the inoperative position of the actuating apparatus, the regulating piston is arranged in its neutral position and the actuating piston is arranged in a position which is determined by the actuation of the regulating valve. In order to generate the regulating force, an actuating lever which is rotatably mounted on a bearing pin and is connected to the actuating piston is provided in the regulating valve in order to generate the regulating force. The magnitude of the regulating force is dependent on the angular position of the actuating lever. Furthermore, two limbs are rotatably mounted on the bearing pin. Said limbs are connected to one another by a tension spring in such a way that a deflection of one of the two limbs relative to the other limb leads to tensioning of the tension spring. A driver pin is arranged at one end of the actuating lever. In the event of a rotary movement of the actuating lever about the bearing pin, the driver pin rests against one of the limbs. When the spring is tensioned, the other limb is supported on an abutment which is provided on the regulating piston and applies the regulating force to said abutment. Two solenoids are provided for adjusting the regulating piston.

DE 100 63 525 B4 discloses a further embodiment of an adjustment apparatus. In this case, an actuating piston of which the movement is controlled by means of a regulating valve is likewise provided. A position of the actuating piston is fed back to the regulating piston of the regulating valve by a driver which is connected to the actuating piston. In this case, the regulating piston can likewise be moved to its regulating positions by means of two solenoids.

Documents DE 103 60 452 B3 and DE 10 2010 054 100 A1 each disclose an adjustment apparatus for a pivot cradle of an axial piston machine. In this case, a pivot angle of the pivot cradle can be pivoted by means of an actuating piston which acts on the pivot cradle. In order to increase the size of the pivot angle, pressure medium can be supplied to an actuating chamber which adjoins the actuating piston, wherein the actuating piston is moved in one direction. The actuating piston is indirectly acted on by a return spring (not shown in this document) in the opposite direction by means of the pivot cradle. A regulating valve is provided in order to supply pressure medium to and to discharge pressure medium from the actuating chamber. Said regulating valve is arranged coaxially in relation to the actuating piston in a common recess together with said actuating piston. In this case, a regulating piston of the regulating valve can be moved to first regulating positions in the direction of the actuating piston by means of a solenoid. A pressure medium connection between the actuating chamber and a low-pressure region of the axial piston machine is controlled in said first regulating positions. A spring force acts on the regulating piston by means of a mating spring, which is supported on the actuating piston, in the direction of second regulating positions, that is to say in a direction away from the actuating piston. The regulating piston controls a pressure medium connection between the actuating chamber and a high-pressure side of the axial piston machine in the second regulating positions. In order to apply the spring force to the regulating piston, said regulating piston projects out of the valve housing and into the actuating chamber by way of its end section, wherein a spring plate for the mating spring is arranged on the end section. The regulating piston is mechanically operatively connected to the actuating piston by the mating spring, this leading to the regulating piston controlling the pressure medium connection between the actuating chamber and the low-pressure side or the high-pressure side of the axial piston machine, depending on a pivot angle of the pivot cradle.

One disadvantage in the embodiments explained above is that, on account of hysteresis of the solenoids, said solenoids move the regulating piston differently when an identical control current is applied. This in turn leads to different adjustment of the actuating piston which in turn adjusts, for example, the pivot cradle at different pivot angles. Hysteresis of the solenoids can therefore lead to pivot angle hysteresis of the pivot cradle. In practice, a deviation in an actual pivot angle in relation to a desired setpoint pivot angle can be, for example, up to 6%.

In contrast, the disclosure is based on the object of providing an actuating apparatus for a hydrostatic piston machine and a hydrostatic piston machine having an adjustment apparatus of this kind, in which adjustment apparatus and hydrostatic piston machine pivot angle hysteresis is comparatively low. In this case, the pivot angle generally represents the deviation in the position of a reciprocating element, which determines the piston stroke, from a neutral position. In an axial piston machine of swash-plate design, the adjustable reciprocating element is the thrust plate which is then called the pivot cradle. In an axial piston machine of inclined-axis design, the adjustable reciprocating element is the cylinder drum. In a radial piston machine or a vane machine, the reciprocating element would be, for example, an eccentric ring.

SUMMARY

The object is achieved by an adjustment apparatus and a hydrostatic piston machine having the features of the disclosure.

According to the disclosure, an adjustment apparatus for a hydrostatic piston machine, in particular for a pivot cradle of an axial piston machine, is provided. The adjustment apparatus has an actuating piston which is provided, in particular, for pivoting the pivot cradle about a pivot axis, wherein the actuating piston delimits an actuating chamber by means of which pressure medium can be applied to said actuating piston. A regulating valve is provided in order to control charging of pressure medium to and discharging of pressure medium from the actuating chamber. Said regulating valve has a regulating piston which can be operated by means of a solenoid. The regulating piston and the actuating piston are mechanically coupled, so that, for example, a pivot angle of the pivot cradle can be fed back to the regulating valve in a mechanical manner. According to the disclosure, current is supplied to the solenoid firstly depending on the initial variable, in particular a setpoint pivot angle of the pivot cradle, and secondly on a previous state of the initial variable, in particular an adjustment direction of the setpoint pivot angle. Therefore, current is supplied to the solenoid not only depending on the value of the setpoint pivot angle, but also depending on the previous state of the setpoint pivot angle.

This solution has the advantage that any influence of hysteresis of the solenoid on a pivot angle of the pivot cradle can be largely avoided. In conventional adjustment apparatuses, a setpoint pivot angle is associated with a control current value for the solenoid, as a result of which a specific control current is supplied to the solenoid of the conventional adjustment apparatus in order to set a specific setpoint pivot angle of the pivot cradle. However, it has been found that a magnetic force, which results from current being supplied to the solenoid, for adjusting the regulating piston has a different magnitude. If, for example, a specific control current is intended to be set on the solenoid, the resulting magnetic force is dependent on whether the control current in the previous state was higher or lower. Therefore, the magnetic force is dependent not only on the control current, but also on the previous state of the control current. If, according to the disclosure, the supply of current to the solenoid additionally depends on the adjustment direction of the setpoint pivot angle, it is advantageously possible for a control current of a first value to be supplied to the solenoid in the event of an increase in the pivot angle to a setpoint pivot angle, and for a control current of a second value to be supplied to said solenoid in the event of a reduction in the pivot angle to the specific setpoint pivot angle. In this case, two control currents are respectively associated with a specific setpoint pivot angle. The adjustment apparatus according to the disclosure provides a cost-effective improvement in regulating accuracy, without mechanical modifications having to be made to the known adjustment apparatuses, like those described in the introductory part.

If the rotation speed of the hydrostatic piston machine is constant, there is a fixed relationship between the pivot angle and the volumetric flow rate. In this case, the supply of current to the solenoid can be made dependent on whether the volumetric flow rate is intended to be increased or reduced. The pivot angle and volumetric flow rate correspond directly in this case.

In a further refinement of the disclosure, a regulating device for actuating the solenoid is provided. Said regulating device controls the solenoid with an actual control current which is converted from a setpoint control current. In this case, the setpoint control current is determined by means of a first setpoint pivot angle/setpoint control current characteristic curve in the event of an increase in the setpoint pivot angle. In the event of the reduction in the setpoint pivot angle, the setpoint control current is determined by the regulating device by means of a second setpoint pivot angle/setpoint control current characteristic curve. There is therefore a map of two setpoint pivot angle/setpoint control current characteristic curves or setpoint volumetric flow rate/setpoint control current curves. It is only necessary to measure the setpoint pivot angle/setpoint control current characteristic curve firstly in the event of an increase in the magnetic current and secondly in the event of a reduction in the magnetic current. The characteristic curves are then stored in the regulating device or in a digital actuation electronics system. If a specific volumetric flow rate or a specific pivot angle for the pivot cradle of the axial piston machine is now required, the respective characteristic curve is used, depending on whether the magnetic current or the actual control current for this has to be increased or reduced.

In a further refinement of the disclosure, the regulating device has a current regulator which is in the form of, in particular, a PID regulator. Said regulator can regulate the actual control current depending on a regulating difference between the setpoint control current and the actual control current, by feeding back said actual control current, for example, to the current regulator.

The actuating apparatus is preferably used to adjust the volumetric flow rate of a hydrostatic axial piston machine in an electroproportional manner. The adjustment apparatus can therefore be used as a so-called power regulator, in order to keep a product of the pressure flow rate and volumetric flow rate constant.

It would be feasible to use the regulating device to actuate further adjustment apparatuses of further hydrostatic piston machines. Actuation can be performed, for example, using a digital electronic controller, for example a digital electronic controller from the Bosch Rexroth RC controller series. Actuation by means of a CAN bus, a CANopen bus or a J1939 bus is also possible.

In one embodiment of the adjustment apparatus, the regulating piston and the actuating piston are arranged in a compact manner approximately coaxially in relation to one another, wherein a regulating spring is clamped in between the regulating piston and the actuating piston. The regulating piston can therefore be moved in the direction of first regulating positions by means of the magnetic force of the solenoid and in the direction of second regulating positions by means of a spring force of the regulating spring. The regulating piston can control a pressure medium connection between the actuating chamber and a high-pressure side of the axial piston machine in the direction of the first regulating positions and can control a pressure medium connection between the actuating chamber and a low-pressure side of the axial piston machine in the direction of the second control positions.

In an alternative embodiment of the adjustment apparatus, two solenoids which move the regulating piston in a respective adjustment direction can be provided. A respective solenoid is then supplied with current depending on the setpoint pivot angle of the pivot cradle and on the adjustment direction of the setpoint pivot angle. Therefore, it is feasible to actuate adjustment apparatuses, like those in documents DE 10 2008 048 507 A1 and DE 100 63 525 B4, using two solenoids in line with the disclosure.

According to the disclosure, a hydrostatic piston machine, in particular an axial piston machine, has a reciprocating element (pivot cradle in the case of an axial piston machine) and an adjustment apparatus according to the disclosure for the reciprocating element, whereby a pivot angle and therefore a volumetric flow rate of the hydrostatic piston machine can be controlled with hysteresis of the solenoids having extremely little influence.

Advantageous developments of the disclosure are the subject matter of further dependent claims.

BRIEF DESCRIPTION OF THE DRAWINGS

Preferred embodiments of the disclosure will be explained in greater detail below with reference to drawings.

In said drawings.

DETAILED DESCRIPTION

Figure 1:
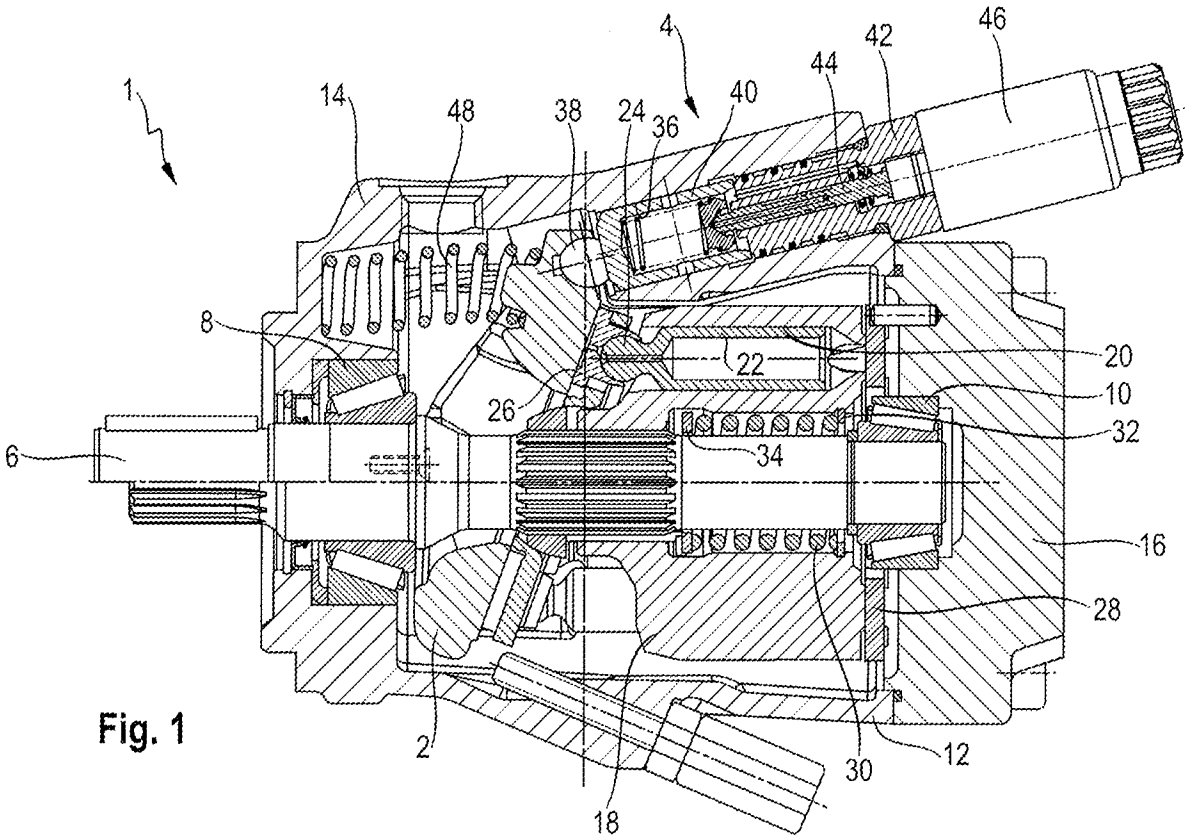
FIG. 1 shows a longitudinal section through an axial piston machine of swash-plate design according to the disclosure having an adjustment apparatus according to the disclosure in line with one embodiment.

The axial piston machine 1, in particular an axial piston pump, with a pivot cradle 2 which can be pivoted about a pivot axis and can be pivoted by an adjustment apparatus 4 according to the disclosure is illustrated in FIG. 1. Said adjustment apparatus is used for the electroproportional adjustment of the volumetric flow rate (EP adjustment) of the axial piston machine 1. A fundamental design of the axial piston machine 1 has long been known in the prior art and for this reason only the features which are essential to the disclosure are explained in the text which follows.

A drive shaft 6 of the axial piston machine 1 is rotatably mounted by means of a first and second roller bearing 8 and 10 in a machine housing 12 of the axial piston machine 1. The machine housing 12 has a pot-like housing section 14 which is closed by a housing cover 16.

A cylinder drum 18 is connected to the shaft 6 in a rotationally fixed manner. Cylinder bores 20 are formed in the cylinder drum 18 such that they are offset in a pitch circle. A piston 22 is arranged in each of said cylinder bores in an axially displaceable manner. A respective piston 22 is connected to a sliding shoe 26 by means of a ball-and-socket joint 24 and is supported on the pivot cradle 2 by means of said sliding shoe. The cylinder bores 20 are connected to a high-pressure side (not illustrated) of the axial piston machine 1 and a low-pressure side (likewise not illustrated) by means of a control plate 28 in which kidney-shaped openings are made. A stroke of the piston 22 in the cylinder bores 20 is prespecified by a pivot angle of the pivot cradle 2. The pivot cradle is shown in its maximum pivotable state, in which a maximum delivery volume is set, in FIG. 1.

The cylinder drum 18 is kept in contact with the control plate 28 by means of a spring 30. To this end, the spring 30 is supported on the cylinder drum 18 by means of a first ring 32 and on the drive shaft 6 by means of a second ring 34. The cylinder drum 18 can be moved in an axial manner in relation to the stationary drive shaft 6 by means of a slot-and-key joint.

The adjustment apparatus 4 according to the disclosure is provided for pivoting the pivot cradle 2. Said adjustment apparatus is accommodated in a receiving bore 36 in the housing section 14 of the machine housing 12, said receiving bore being formed laterally in the cylinder drum 18. The adjustment apparatus 4 has an actuating piston 40 which is connected to the pivot cradle 2 by means of a ball-and-socket joint 38 and which is axially guided in the receiving bore 36. A regulating valve 42 is inserted into the receiving bore 36, axially following the actuating piston, in a coaxial manner in relation to said actuating piston. Said regulating valve has a regulating piston 44 which can be operated by means of an electrical actuator in the form of a solenoid 46.

A return force of a return spring 48 is applied to the pivot cradle 2 against an actuating force of the actuating piston 40, said return spring being supported on the machine housing 12. Said return spring acts on the pivot cradle 2 on that side of the pivot cradle which faces away from the actuating piston 40 approximately opposite to the ball-and-socket joint 38.

Figure 2:
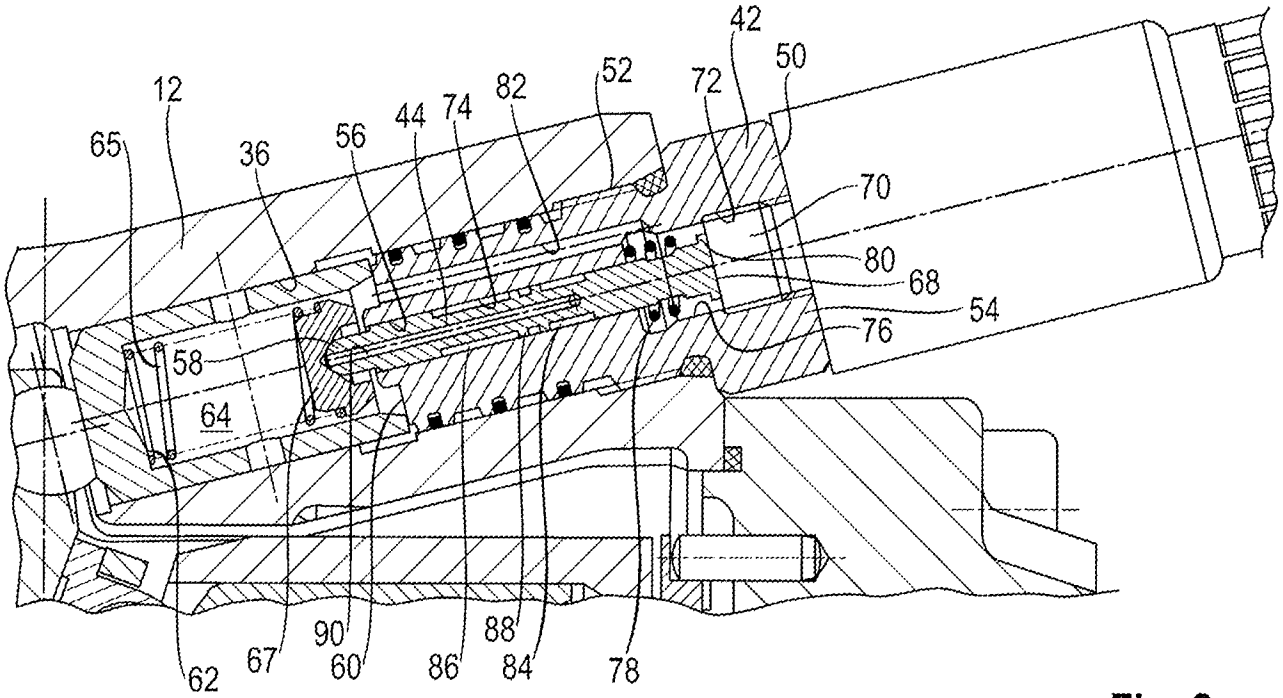
FIG. 2 shows an enlarged detail of the axial piston machine from FIG. 1 in the region of the adjustment apparatus.

According to FIG. 2, the regulating valve 42 has a valve housing 50 which is in the form of a valve sleeve. Said valve housing is screwed into an internal thread 52 of the receiving bore 36. A screw-in depth of the valve housing 50 is restricted by a radially widened housing section 54 of the valve housing which can rest against the machine housing 12 by way of its annular end face, which faces the actuating piston 40, in the screwed-in state. A piston bore 56 is provided in the valve housing 50 and passes through the entire valve housing. The regulating piston 44 is guided in the piston bore 56 in a sliding manner. Said regulating piston has an end section 58 which projects out of the valve housing 50 in the direction of the actuating piston 40. An end face 60 of the valve housing 50 from which the end section 58 of the regulating piston 44 projects, together with the end section 58 and a piston face 62, which faces the valve housing 50, of the actuating piston 40 and the receiving bore 36, delimits an actuating chamber 64. Pressure medium can be applied to the actuating piston 40 by means of said actuating chamber.

A regulating spring 65 which is clamped in between the actuating piston 40 and the regulating piston 44 is arranged in the actuating chamber 64. In this case, the regulating spring 65 is supported on a spring plate 67 which is mounted on the end section 58 of the regulating piston 44.

An approximately flat end face 68 which faces the solenoid 46 and extends in the radial direction with respect to the longitudinal axis of the regulating piston 44 is formed on the other end section 66 of the regulating piston 44. An armature tappet (not illustrated) of the solenoid 46 acts on said end face in order to move the regulating piston 46 in the direction of the actuating piston 40 using magnetic force. The solenoid 46 is screwed into a thread section 72 of the piston bore 56 by way of a pole shoe 70. A screw-in depth of the solenoid 46 is limited by a housing face, which faces the valve housing 42, of the solenoid 46 resting, for example, on that end face of the valve housing 50 which faces the solenoid 46.

The regulating piston 44 is guided in a guide section 74 of the piston bore 56 in a sliding manner, said guide section extending from the end face 60 of the valve housing 50 in the direction of the solenoid 46. Following the guide section 74, the piston bore 56 has a radially widened step 76 which is adjoined by the thread section 72. The step 76 and the thread section 72 have approximately the same inside diameter. A mating spring 78 is arranged in the region of the step 76 in the valve housing 50, said mating spring being supported on the valve housing 50 and applying a spring force against the magnetic force or in a direction away from the actuating piston 40 to the regulating piston 44 by means of a radial collar 80.

A blind bore 82 is made in the valve housing 50 at a parallel distance from the piston bore 56, said blind bore extending from the end face 60 and issuing into the piston bore 56 in the region of the step 76, as a result of which the regulating piston 44 is pressure-compensated at the end face in respect of the actuating pressure.

The regulating piston 44 has a first and second annular groove 84 and 86 which are arranged in series and, together with the piston bore 56, delimit a respective annular space in the region of the guide section 74. A radial collar 88 is formed on the regulating piston 44 by the annular grooves 84 and 86 between said annular grooves. The annular space which is arranged closer to the solenoid 46 in FIG. 2 and is delimited by the annular groove 84 is connected to a tank channel (not illustrated) which is formed in the valve housing 50 and, in turn, can be connected to a tank or to a low-pressure side of the axial piston machine 1. The other annular space, which is delimited by the annular groove 86, is connected to a delivery pressure channel (not illustrated) which is formed in the valve housing 50 and, in turn, can be connected to a high-pressure side of the adjustment pump. Furthermore, an actuating pressure channel (not illustrated) is formed radially in relation to the piston bore 56 in the valve housing 50, said actuating channel passing through the entire valve housing. Two longitudinal bores (not illustrated) which extend from the end face 60 of the valve housing 50 at a parallel distance from the piston bore 56 and connect the actuating chamber 64 to the actuating pressure channel (not illustrated) issue into said actuating pressure channel. The regulating piston 44 can be moved axially in an adjustment direction, in which it is moved away from the solenoid 46, by means of the armature tappet (not illustrated) of the solenoid 46. In this adjustment direction, the regulating piston 44 controls a pressure medium connection between the annular space, which is delimited by the annular groove 84 and is connected to the tank channel (not illustrated), and the actuating pressure channel (not illustrated) by means of its radial collar 88. In the opposite adjustment direction, that is to say when the control piston 44 is moved in the direction of the solenoid 46, said regulating piston controls a pressure medium connection between the annular space, which is delimited by the annular groove 86 and is connected to the delivery pressure channel (not illustrated), and the actuating pressure channel (not illustrated) by means of its radial collar 88.

A lubricant channel 90 of the regulating piston 44 issues into an end face of the end section 58 of the regulating piston 44, said lubricant channel being made in the regulating piston 44 and connecting the end face of the end section 58 to the annular space which is delimited by the annular groove 84 and is connected to the low-pressure side of the axial piston machine. The contact areas between the spring plate 67 and the regulating piston 44 are lubricated in this way.

The arrangement of the actuating piston 40, the return springs 48, the regulating spring 65, the regulating piston 44 and the solenoid 46 leads to a pivot angle and therefore a swept volume of the axial piston machine 1 changing in proportion to the magnetic force of the solenoid, that is to say in proportion to the actual control current flowing through the solenoid.

In order to pivot the pivot cradle 2, pressure from the high-pressure side of the axial piston machine 1 is applied to the actuating chamber 64 by means of the regulating valve 42. During operation of the axial piston machine 1 as a pump, the actuating piston 40 extends, with the effect of reducing the pivot angle and the swept volume of the axial piston machine 1, until the force which is generated by the pressure on the actuating piston 40 corresponds to the force of the return spring 48. If an actual control current of a certain level is now applied to the solenoid 46, said solenoid moves the regulating piston 44 of the regulating valve 42 until it stops in the position in which pressure medium can be discharged from the actuating chamber 64 to the low-pressure region of the axial piston machine via the annular space 84. The actuating piston 40 begins to retract under the action of the return spring 48. In the process, the regulating spring 65 is increasingly tensioned, until the force which is exerted by said regulating spring corresponds to the magnetic force of the solenoid 46. Starting from this moment, said force which is exerted by the regulating spring can move the regulating piston 44 against the magnetic force until it reaches its regulating positions in which the position reached by the actuating piston 40 and therefore a specific pivot angle is maintained by small regulating movements of the regulating piston 44. The higher the actual control current flowing through the solenoid 46, the greater the pivot angle of the pivot cradle 2.

Figure 3:
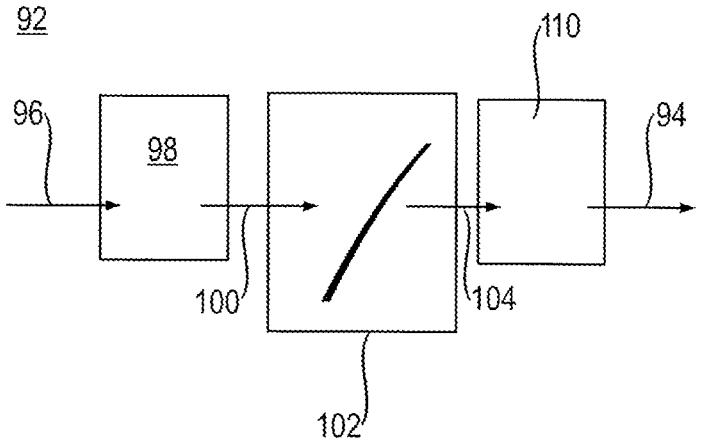
FIG. 3 shows a block diagram of a regulating device of the adjustment apparatus according to the disclosure.

In conventional adjustment apparatuses, for example those known from the prior art described in the introductory part, a specific actual control current of the solenoid leads to different magnetic forces depending on whether the actual control current was higher or lower previously, whereby the magnetic force depends on the previous state of the actual control current. The adjustment apparatus 4 according to the disclosure is provided in order to ensure that the different magnetic forces for a specific actual control current of the solenoid 46 do not lead to undesired hysteresis of the pivot angle. According to FIG. 3, said adjustment apparatus has a regulating device 92 in which an actual control current 94 depends firstly on a setpoint pivot angle 96 and secondly on an adjustment direction of the setpoint pivot angle 96. The setpoint pivot angle 96 is used as a guide variable for the regulating device 92. Said guide variable is a voltage which lies, for example, between 0 and 5 volts. This voltage is scaled to internal values by the regulating device 92, this being illustrated by block 98. In this case, the scaling is performed, for example, in such a way that 2.5 volts corresponds to a pivot angle of 0%, 0 volt corresponds to a pivot angle of −100%, and 5 volts corresponds to a pivot angle of 100%. The setpoint pivot angle 100 which is scaled to an internal value is assigned to a setpoint control current 104 by means of a setpoint pivot angle/setpoint control current map 102 of characteristic curves. A characteristic map 102 of this kind is illustrated in FIG. 4 by way of example.

Figure 4:
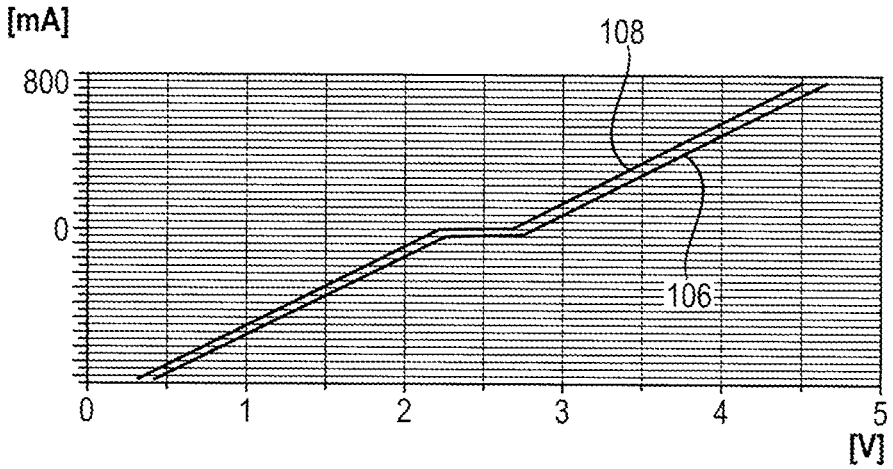
FIG. 4 shows a characteristic map of the adjustment apparatus.

The characteristic map 102 of FIG. 4 has a first setpoint pivot angle/setpoint control current characteristic curve 106 and a second setpoint pivot angle/setpoint control current characteristic curve 108. The setpoint pivot angle is plotted in volts on the abscissa in the map of characteristic curves in FIG. 4 and the setpoint control current is plotted in mA on the ordinate. If, for example, a setpoint pivot angle of 3.5 volts is intended to be set by regulation, the characteristic curve 106 which is lower in FIG. 4 will be used by the regulating device 92 in order to determine the corresponding setpoint control current if said setpoint pivot angle was previously lower. If, instead, the setpoint pivot angle is reduced to the desired value of 3.5 volts, the characteristic curve 108 which leads to another setpoint control current will be used. The setpoint control current 104 which is determined by means of the characteristic map 102 is then converted into the actual control current 94 by means of a current regulator 110, see FIG. 3. The current regulator 110 has a P component and an I component, a dither frequency and a coil resistance as parameters. In this case, the actual control current 94 can be fed back to the current regulator 110. The actual control current 94 is then supplied to the solenoid 46. Owing to the use of the characteristic curves 106 and 108 from FIG. 4, the setpoint pivot angle 100 leads, for example, to a single actual pivot angle which is set by the adjustment apparatus 4 by virtue of current being supplied to the solenoid 46.

An adjustment apparatus for a pivot cradle of an axial piston machine is disclosed, in particular according to the disclosure. The pivot cradle can be pivoted about a pivot axis by means of an actuating piston. The actuating piston delimits an actuating chamber by means of which pressure medium can be applied to the actuating piston. Charging of pressure medium to and discharging of pressure medium from the actuating chamber can be controlled by means of a regulating valve. Said regulating valve has a regulating piston which can be adjusted by means of a solenoid. Furthermore, the regulating piston and the actuating piston are mechanically coupled to one another. In this case, current is supplied to the solenoid depending on a setpoint pivot angle of the pivot cradle and depending on the previous state of the setpoint pivot angle, this leading to hysteresis effects of the solenoid being largely reduced.

LIST OF REFERENCE SYMBOLS

1 Axial piston machine
2 Pivot cradle
4 Adjustment apparatus
6 Drive shaft
8 Roller bearing
10 Roller bearing
12 Machine housing
14 Housing section
16 Housing cover
18 Cylinder drum
20 Cylinder bore
22 Piston
24 Ball-and-socket joint
26 Sliding shoe
28 Control plate
30 Spring
32 Ring
34 Ring
36 Receiving bore
38 Ball-and-socket joint
40 Actuating piston
42 Regulating valve
44 Regulating piston
46 Solenoid
48 Return spring
50 Valve housing
52 Internal thread
54 Housing section
56 Piston bore
58 End section
60 End face
62 Piston face
64 Actuating chamber
65 Regulating spring
66 End section
67 Spring plate
68 End face
70 Pole tube
72 Thread section
74 Guide section
76 Step
78 Mating spring
80 Radial collar
82 Blind bore
84 Annular groove
86 Annular groove
88 Radial collar
90 Lubricant channel
92 Regulating device
94 Actual control current
96 Setpoint pivot angle
98 Block
100 Setpoint pivot angle
102 Setpoint pivot angle/setpoint control current characteristic map
104 Setpoint control current
106 Characteristic curve
108 Characteristic curve
110 Current regulator

What is claimed is:

1. An adjustment apparatus for adjusting a pivot cradle of a hydrostatic piston machine, comprising:
- an actuating piston;
- and a regulating valve including a regulating piston that is mechanically operatively connected to the actuating positon such that a position of the regulating piston depends on a position of the actuating piston;
- a solenoid configured to adjust the regulating piston to control charging of pressure medium to and discharging of pressure medium from an actuating chamber adjacent to the actuating piston; and
- a regulating device configured to drive the solenoid with a control current based on pre-determined characteristic curves, the control current determined by:
  - scaling a setpoint pivot angle of the pivot cradle to produce a guide voltage;
  - assigning the guide voltage to a setpoint current via:
    - a first characteristic curve when the setpoint pivot angle of the pivot cradle is greater than a previous pivot angle of the pivot cradle; and
    - a second characteristic curve when the setpoint angle is less than a previous pivot angle of the pivot cradle; and
  - converting the assigned setpoint current into the control current.

2. The adjustment apparatus according to claim 1, wherein the regulating device regulates the actual control current using a current regulator depending on a regulating difference between the setpoint control current and the actual control current.

3. The adjustment apparatus according to claim 1, wherein the adjustment apparatus is configured to adjust the volumetric flow rate of the axial piston machine in an electroproportional manner.

4. The adjustment apparatus according to claim 1, wherein further adjustment apparatuses of further hydrostatic piston machines are configured to be controlled by the regulating device.

5. The adjustment apparatus according to claim 1, wherein the regulating piston and the actuating piston are arranged approximately coaxially in relation to one another, and wherein a regulating spring is clamped in between the regulating piston and the actuating piston.

6. The adjustment apparatus according to claim 5, wherein a magnetic force of the solenoid is configured to be applied to the regulating piston in the direction of first regulating positions in which a pressure medium connection between the actuating chamber and a high-pressure side of the axial piston machine is configured to be controlled, and wherein a spring force of the regulating spring is configured to be applied to the regulating piston in the direction of second regulating positions in which a pressure medium connection between the actuating chamber and a low-pressure side of the axial piston machine is configured to be controlled.

7. The adjustment apparatus according to claim 1, wherein the regulating piston is configured to be operated by two solenoids.

8. A hydrostatic piston machine, comprising:

a pivot cradle; and an adjustment apparatus configured to adjust the pivot cradle, the adjustment apparatus including:

an actuating piston;

and a regulating valve including a regulating piston that is mechanically operatively connected to the actuating positon such that a position of the regulating piston depends on a position of the actuating piston;

a solenoid configured to adjust the regulating piston to control charging of pressure medium to and discharging of pressure medium from an actuating chamber adjacent to the actuating piston; and a regulating device configured to drive the solenoid with a control current, the control current determined by:

scaling a setpoint pivot angle of the pivot cradle to produce a guide voltage;

assigning the guide voltage to a setpoint current via:

a first characteristic curve when the setpoint pivot angle of the pivot cradle is greater than a previous pivot angle of the pivot cradle; and a second characteristic curve when the setpoint angle is less than a previous pivot angle of the pivot cradle; and converting the assigned setpoint current into the control current.

9. The adjustment apparatus according to claim 1, wherein the adjustment apparatus is configured to adjust the pivot cradle of an axial piston machine.

10. The adjustment apparatus according to claim 2, wherein the current regulator is configured as a PID regulator.

11. The hydrostatic piston machine according to claim 8, wherein the hydrostatic piston machine is configured as an axial piston machine.

* * * * *